US009468802B2

(12) United States Patent
Gutierrez

(10) Patent No.: US 9,468,802 B2
(45) Date of Patent: Oct. 18, 2016

(54) PERSONAL, MULTIPLE MUSCLE RESISTANCE, AND BALANCE TRAINING APPARATUS AND RELATED METHODS

(71) Applicant: Alyssa Gutierrez, San Pedro, CA (US)

(72) Inventor: Alyssa Gutierrez, San Pedro, CA (US)

( * ) Notice: Subject to any disclaimer, the term of this patent is extended or adjusted under 35 U.S.C. 154(b) by 0 days.

(21) Appl. No.: 14/574,920

(22) Filed: Dec. 18, 2014

(65) Prior Publication Data

US 2015/0182793 A1 Jul. 2, 2015

Related U.S. Application Data

(60) Provisional application No. 61/964,293, filed on Dec. 31, 2013.

(51) Int. Cl.

| | |
|---|---|
| ***A63B 21/02*** | (2006.01) |
| ***A63B 23/035*** | (2006.01) |
| ***A63B 21/055*** | (2006.01) |
| ***A63B 21/04*** | (2006.01) |
| *A63B 23/04* | (2006.01) |
| *A63B 23/12* | (2006.01) |

(52) U.S. Cl.

CPC ..... *A63B 23/03575* (2013.01); *A63B 21/023* (2013.01); *A63B 21/0442* (2013.01); *A63B 21/0557* (2013.01); *A63B 21/4011* (2015.10); *A63B 21/4025* (2015.10); *A63B 21/4035* (2015.10); *A63B 23/03541* (2013.01); *A63B 23/0405* (2013.01); *A63B 23/1209* (2013.01)

(58) Field of Classification Search

CPC ..... A63B 21/0004; A63B 21/00043; A63B 21/00058; A63B 21/00061; A63B 21/00065; A63B 21/00076; A63B 21/00185; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/153; A63B 21/16; A63B 21/4001; A63B 21/4011; A63B 21/4017; A63B 21/4019; A63B 21/4023; A63B 21/4025; A63B 21/4033; A63B 21/4035; A63B 21/4039; A63B 23/035; A63B 23/03508; A63B 23/03516; A63B 23/03533; A63B 23/03541; A63B 23/0355; A63B 23/03575; A63B 23/04; A63B 23/0405; A63B 23/0482; A63B 23/0494; A63B 23/12; A63B 23/1209; A63B 23/1245; A63B 23/1281; A63B 69/0057; A63B 69/0059; A63B 2069/0062; A63B 2208/0204

See application file for complete search history.

(56) References Cited

U.S. PATENT DOCUMENTS 3,162,441 A * 12/1964 Karlik ..... A63B 21/0004 482/124
3,162,442 A * 12/1964 Karlik ..... A63B 21/0004 24/129 R (Continued)

*Primary Examiner* — Oren Ginsberg
*Assistant Examiner* — Gary D Urbiel Goldner
(74) *Attorney, Agent, or Firm* — Buche & Associates, P.C.; John K. Buche; Bryce A. Johnson

(57) ABSTRACT

The present invention is an exercise device that provides resistance training to both lower and upper body muscle groups. While the device is capable of working both the lower and upper body at the same time, the lower and upper body portions of the device work independently. The lower body section features two spirals wound in opposite directions that maintain a constant force throughout the exercise.

15 Claims, 7 Drawing Sheets

(56) References Cited

U.S. PATENT DOCUMENTS 3,411,500 A * 11/1968 Gatts ..... A63B 21/023 600/20
3,659,846 A * 5/1972 Kanicki ..... A63B 21/023 2/24
4,033,580 A * 7/1977 Paris ..... A63B 21/0004 482/122
4,245,840 A * 1/1981 Van Housen ..... A63B 21/0004 24/115 H
4,340,218 A * 7/1982 Wilkinson ..... A63B 21/00047 482/129
4,343,466 A * 8/1982 Evans ..... A63B 21/018 140/71 R
4,815,731 A * 3/1989 Suarez ..... A63B 21/055 482/124
4,909,506 A * 3/1990 Smith ..... A63B 21/0004 482/124
5,224,913 A * 7/1993 Rodibaugh ..... A63B 21/0004 482/124
5,490,826 A * 2/1996 Rose ..... A63B 21/0004 482/124
5,688,213 A * 11/1997 Recker ..... A63B 21/0004 482/125
6,036,626 A * 3/2000 Taylor ..... A63B 21/0004 482/121
6,517,470 B1 * 2/2003 Chak ..... A63B 21/0004 482/121
2005/0059537 A1 * 3/2005 Hull ..... A63B 21/0004 482/124
2010/0255964 A1 * 10/2010 Wang ..... A63B 21/00043 482/122
2010/0292055 A1 * 11/2010 Andrich ..... A63B 21/00043 482/122
2011/0045954 A1 * 2/2011 Gutierrez ..... A63B 21/00 482/51
2012/0100967 A1 * 4/2012 Leibowitz ..... A63B 21/0023 482/124
2014/0200499 A1 * 7/2014 Champion ..... A61H 1/0292 602/36

* cited by examiner

PERSONAL, MULTIPLE MUSCLE RESISTANCE, AND BALANCE TRAINING APPARATUS AND RELATED METHODS

CROSS-REFERENCE TO RELATED APPLICATIONS

This application claims the benefit of U.S. Provisional Patent Application No. 61/964,293 filed on Dec. 31, 2013 entitled "The Spiral Science Fit." The previous application is hereby incorporated by reference in the entirety.

STATEMENT REGARDING FEDERALLY SPONSORED RESEARCH OR DEVELOPMENT

Not applicable.

BACKGROUND OF INVENTION

1. Field of the Invention

The disclosed subject matter is in the field of exercise training equipment. More specifically, the subject matter of this disclosure is in the field of balance and resistance training equipment.

2. Background of the Invention

Resistance training is a popular method of physical exercise that uses resistance to induce muscular contraction for increasing muscular strength, size, balance, and/or endurance. Resistance training is frequently featured in Pilates classes, core training workouts, and strength training regimens. Balance and resistance training provides improved muscle strength and tone, weight loss, decreased risk of injury, increased balance, better posture, and an overall improved sense of well-being. In some cases, balance and resistance training involves exercises performed with resistance bands. These resistance band exercises involve a physical movement that stretches the bands so that the bands provide resistance with the movement.

There are several resistance band products that are commercially available for balance and resistance training. The most basic band is a long (e.g., two to four feet) rubber tube with handles on either end. These basic bands are typically available in a variety of different resistance levels. These bands are portable, lightweight, and versatile so that a user can perform a variety of different exercises with them, utilizing a variety of different muscle groups. The basic resistance bands are limited, though, because only one muscle group at a time can be exercised with the bands. Also, the handles of the basic workout band have a tendency to slip when performing certain exercises that are not hands-on. In other words, a basic resistance band does not have a mechanism for holding the band against a user's leg for leg exercises or for exercises that require stretching the band against inanimate objects and, as a result, the band can easily slip or fall out of place (e.g., the handles can slip of a shoe or post). Finally, basic resistance bands can result in inconsistent training because acceleration and force of movements during the exercise will vary based on how far the band is stretched.

Another type of resistance bands are lateral resistance bands. Lateral resistance bands are essentially large rubber loops that are available in a variety of different resistances. A user places a band around their calves or thighs and performs basic leg movements to stretch the loop. Although uncomplicated to use, lateral bands are problematic because the rubber can chafe a user's skin and potentially cause blisters. Also, lateral bands can commonly slip out of position when the user perspires.

One improvement to known resistance bands and lateral bands is the incorporation of a leg cuffs for securing the band to a user for leg exercises. In some embodiments, leg cuffs are vinyl garter-like devices that fit snuggly around the ankle. Resistance tubing can be hooked onto the leg cuffs, giving the user the same effect as the lateral bands without the slipping and blistering problems. Still, theses cuffed bands only allow for a user to work out one muscle group at a time and the bands cannot maintain a constant force and acceleration during repeated exercise movements.

One product that allows a user to use balance and resistance training to exercise multiple muscle groups at one time is the Core X system. The Core X system consists of two resistance bands that are coupled together by a center unit to form an "X" shape. The ends of the bands are tethered to leg and wrist cuffs. A user attaches the leg cuffs around the thighs and the wrist cuffs around the wrists. The amount of resistance can be adjusted using the center unit. The Core X allows a user to add resistance training to both the upper and lower body at the same time. However, with the Core X system, the resistance bands are coupled together in a manner that the amount of effort a user exerts in the upper body affects the amount of resistance in the lower body. Furthermore, the Core X system has the same limitations as other resistance products, namely, the resistance force will not be uniform through the exercise. Furthermore, lower body and upper body portions of the CORE X system cannot be used separately.

Thus, there is a need for a resistance training device that works out both the upper body and the lower body at the same time wherein the movement of one muscle group part does not affect the resistance in the other.

SUMMARY OF THE INVENTION

It is an object of the invention to create a single exercise device that allows for both upper body and lower body workouts.

It is another object to create an invention that can be operated by an individual without the assistance of a coach or trainer.

It is another object of the invention to create a device where speed, acceleration, and force are uniformly regulated through the full body exercise routine.

Disclosed is an exercise device featuring two leg cuffs; a large spiral constructed from a stretchable material connected to the leg cuffs; a smaller spiral constructed from a stretchable material between the inner loops of the larger spiral; and two arm bands that are each coupled to a leg cuff.

BRIEF DESCRIPTION OF THE FIGURES

The manner in which these objectives and other desirable characteristics can be obtained is explained in the following description and attached figures in which.

FIGURES NOT TO SCALE

DETAILED DESCRIPTION OF THE INVENTION

Generally disclosed is an exercise device featuring two leg cuffs; a large spiral constructed from a stretchable material connected to the leg cuffs; a smaller spiral constructed from a stretchable material inside the inner loops of the larger spiral; and two arm bands that are each coupled a leg cuff. The more specific aspects of the device are disclosed with reference to the attached figures.

Figure 1:
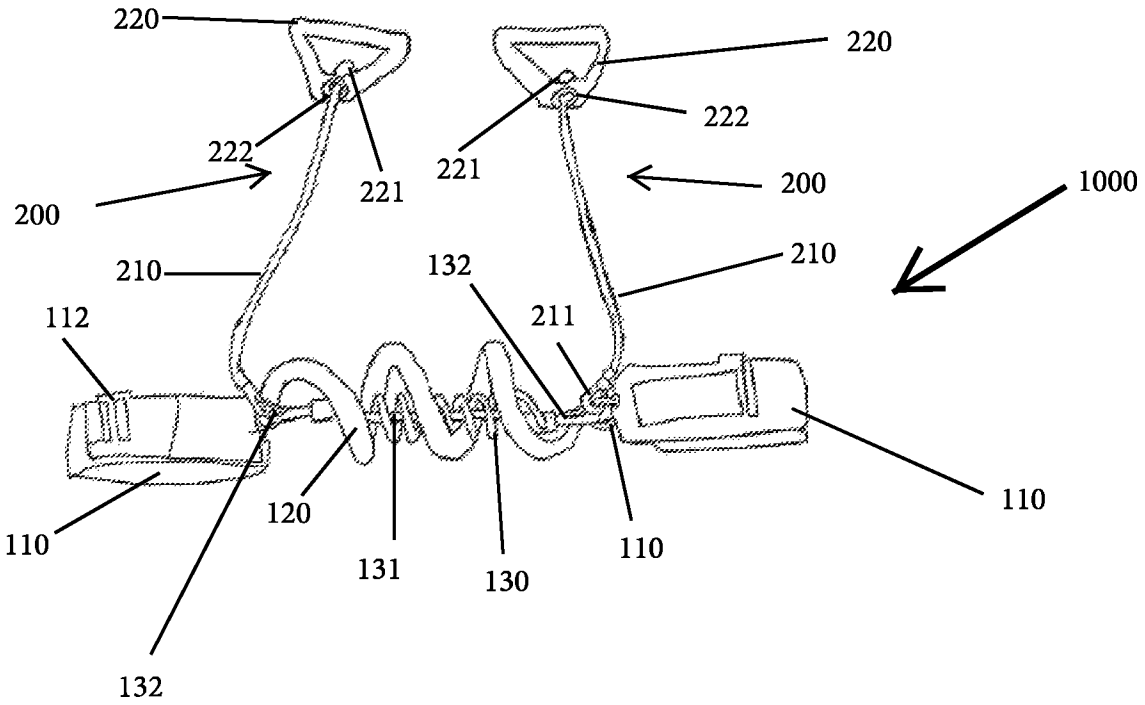
FIG. 1 is a front view of the training device.

FIG. 1 shows a front view of the device 1000. As shown, the device 1000 consists of two leg cuffs 110. Attached to the leg cuffs 110 may be a large spiral 120. Within the inner diameter of the loops of the large spiral 120, is preferably disposed a smaller spiral 130. In some embodiments, the device 1000 will also feature stretchable tubing 131 within the loops of the small spiral 130. In the figure, the large spiral 120 is attached to the leg cuffs using ball stops. (see FIGS. 7, 125) The small spiral 130 along with the tubing 131 is attached to the leg cuffs 110 by connecting a clip 132 to a ring 111 attached to the leg cuff 110. In the preferred embodiment, the small spiral 130 is attached to the leg cuffs 110 by a snap clip 132, but other mechanisms may be used to connect the small spiral 130 to the leg cuffs 110. Also attached to the leg cuffs 110, in this embodiment, are arm bands 200. The arm bands 200 may consist of tubing 210 and a handle 220. In the preferred embodiment, the tubing 210 is attached to the handle 220 using a grommet 222 and ball stop 221 although other modes of connection are possible. The arm bands 210 connect to the leg cuffs 110 via a clip 211 around the ring 111. In the preferred embodiment, a snap clip 211 connects the arm bands 210 to the leg cuffs 110, but other connecting mechanisms may be used.

Figure 2:
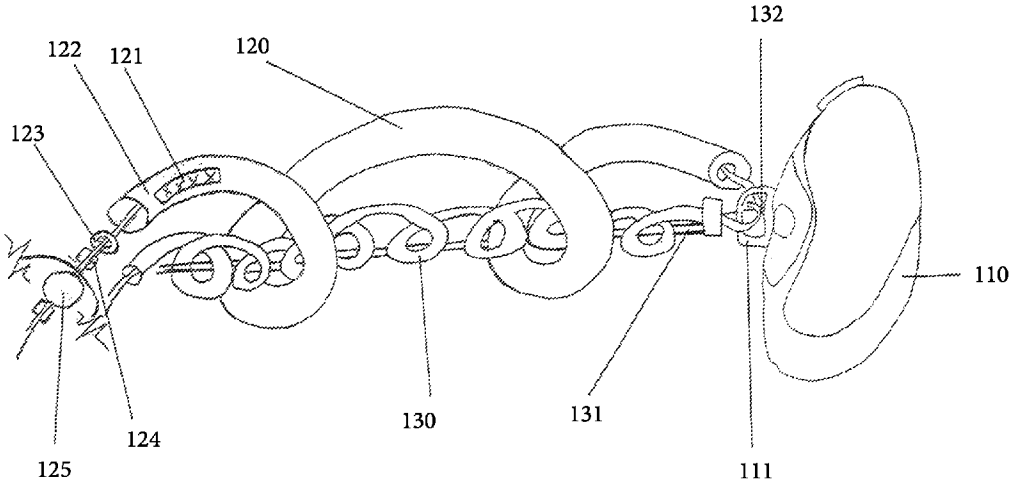
FIG. 2 is a detailed view of the lower body section of the device in FIG. 1.

FIG. 2 is a detailed view of the spirals 120, 130. The large spiral 120 contains a core 121 inside of a casing 122. The core 121 is preferably a braided strand of non-stretchable material, but could also be a bungee cord. A bungee cord typically consists of elastic strands surrounded by a woven seal, typically of cotton or polypropylene materials. The casing 122 is constructed from a sturdy, yet stretchable material such as foam. The smaller spiral is preferably constructed from a stretchable material. The preferred embodiment features tubing 131 between the loops of the small spiral 130. The tubing 131 is preferably made from latex, but may be constructed from any stretchable material such as rubber or elastic.

Still referring to FIG. 2, in the preferred embodiment the large spiral 120 and the small spiral 130 are wound in opposite directions. In the preferred embodiment, the large spiral 120 is wound in a clock-wise direction and the small spiral 130 is wound in a counter-clockwise direction. When a user performs a leg exercise using the device 1000, the two spirals 120, 130 rotate in opposite directions. As acceleration is increased through repetitive body extremity movement, both spirals 120, 130 produce energy directed toward the center. The rotation differential of the two spirals 120, 130 produces a controlled and constantly applied energy release when the device 1000 is extended and contracted. Speed acceleration and force are uniformly regulated through the full body exercise routine, which permits biomechanically correct muscle sequencing to occur, while also maintaining the body's normal posture, stabilization, and flexibility through the performance of exercise.

Figure 3:
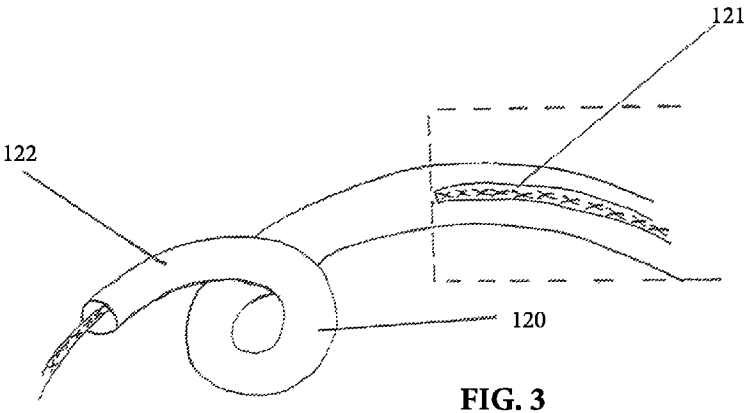
FIG. 3 is a detailed view of the spiral section of FIG. 2.

FIG. 3 depicts a detailed view of the large spiral 120, specifically the core 121 and the outer casing.

Figure 4:
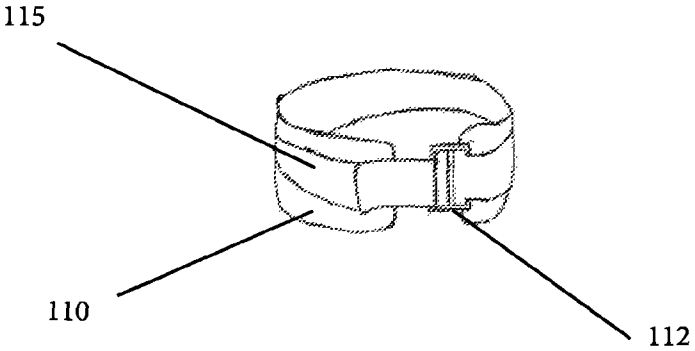
FIG. 4 is a perspective view of the leg cuff of the device of FIG. 1.
Figure 5:
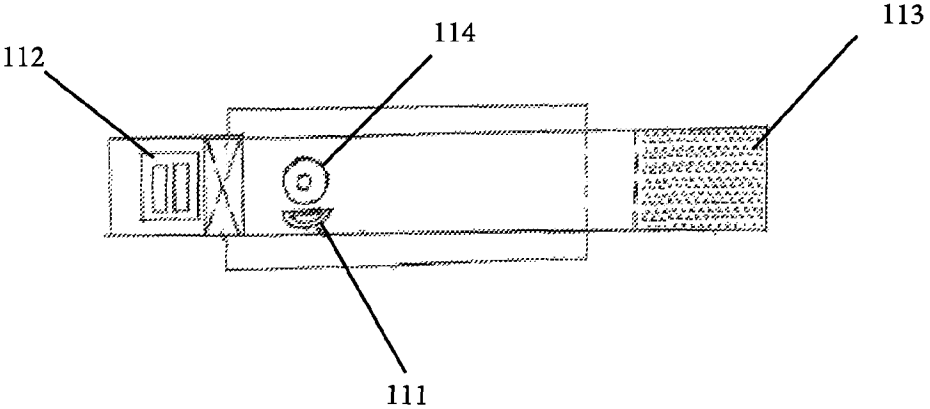
FIG. 5 is a front view of an unattached leg cuff of FIG. 4.

FIGS. 4 and 5 depict the leg cuff 110. The leg cuff 110 consists of a strap that is capable of forming a loop. One end of the strap of the leg cuff 110 features a hook and loop fastener. In order to form a loop, one end 113 is inserted into a belt loop 112 where the end 113 can be attached to the other half of the hook and loop fastener 115. The leg cuff 110 is designed to be worn in the lower leg patellar area, but the size can be adjusted so that it fits around other parts of the leg. The leg cuff 110 features a ring 111 and a grommet 114. The ring 111 is used to attach the small spiral 130 and the arm bands 200 to the leg cuff 110 and the grommet 114 is used to attach the large spiral 120 to the leg cuff 110. The leg cuff 130 is preferably made from nylon. It may also be constructed from another fabric such as lycra or polyester, or it may be constructed from a flexible plastic material. The ring 111 is preferably a stainless steel "D" ring with a minimum tensile strength of 400 lbs, but it may be constructed from another metal or a strong plastic. In the preferred embodiment, the ring 111 is attached to the leg cuff 110 by encasing the ring 111 in a jacketed sewing method by sewing the jacket to the leg cuff 110 using ultra poly thread.

Figure 6:
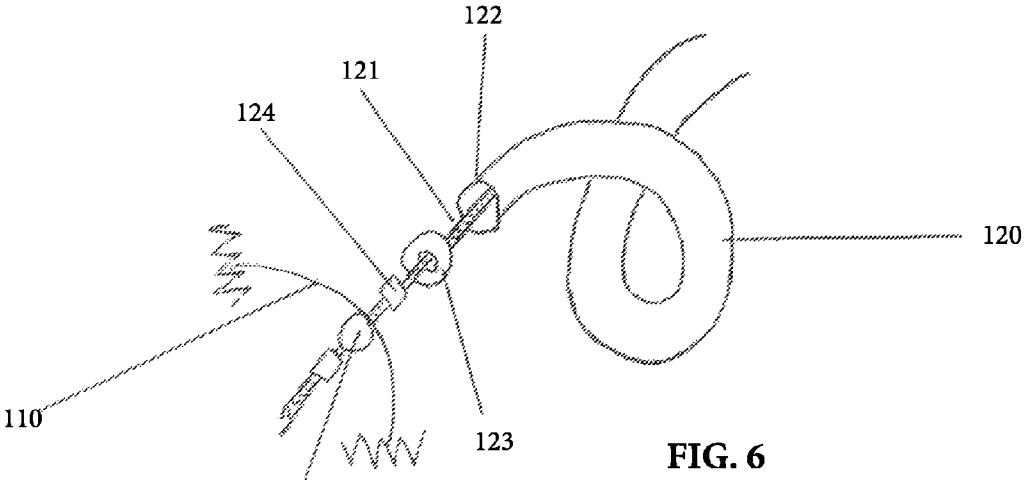
FIG. 6 is a detailed view of the where the spiral section connects with the leg cuff.

FIG. 6 is detailed view of the mechanism for attaching the large spiral 120 to the leg cuff 110 in the preferred embodiment. In this drawing the braided strand 121 is inserted through the grommet 114 (see FIG. 5). On one side of the grommet 114 is a ball stop 125. On the other side of the grommet 114 is a stop button 124. In addition to the ball stop 125 and stop button 124, there is also a washer 123, which serves as a tension holding plate. The washer 123 serves as a tension holding plate and there is one at each end of the spiral. The ball stop 125 is preferably a one-eight inch oblique nylon rope ball stop, but other ball stops can be used. The stop button 124 is preferably constructed from aluminum, but may be constructed from another metal or a strong plastic material. The washer 123 is preferably seven sixteenth inch stainless steel washer.

Figure 7:
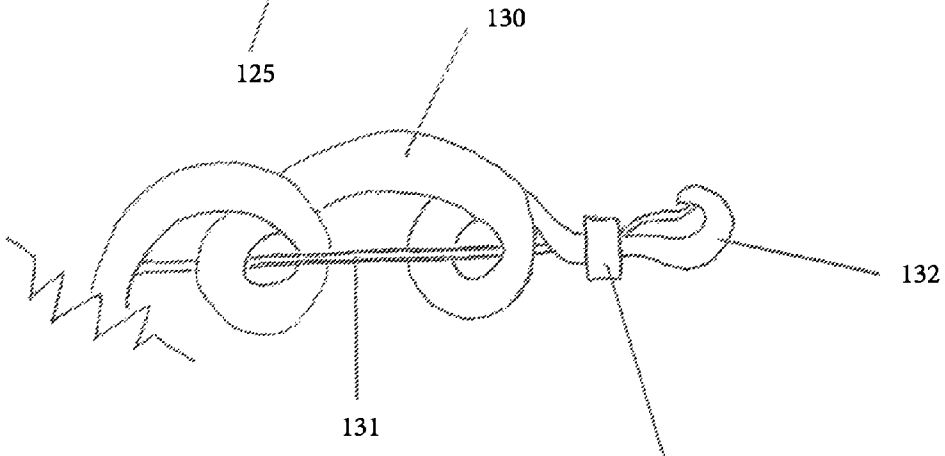
FIG. 7 is a detailed view of the small spiral of the exercise device.

FIG. 7 is a detailed view of the mechanism that connects the small spiral 130 to the leg cuff 110. The small spiral 130 is connected to the leg cuff 110 via a clip 132. In this embodiment, the clip 132 is constructed from the same material as the small spiral 130, which is a durable material such as metal or nylon. The end of the small spiral 130 forms a loop that is held in place with a stop button 133. The clip 132 is inserted around the ring 111 during the manufacturing process. In this embodiment, the small spiral 130 cannot be removed from the leg cuff 110. In an alternate embodiment, the small spiral 130 is attached to the leg cuff 110 using a hook, clasp, carabineer, or another removable mechanism. This way, the small spiral 130 can be detached in order for the user to perform an exercise that calls for less resistance. The small spiral 130 can also be replaced with another small spiral 130 with more resistance when an exercise calls for greater resistance.

Figure 8:
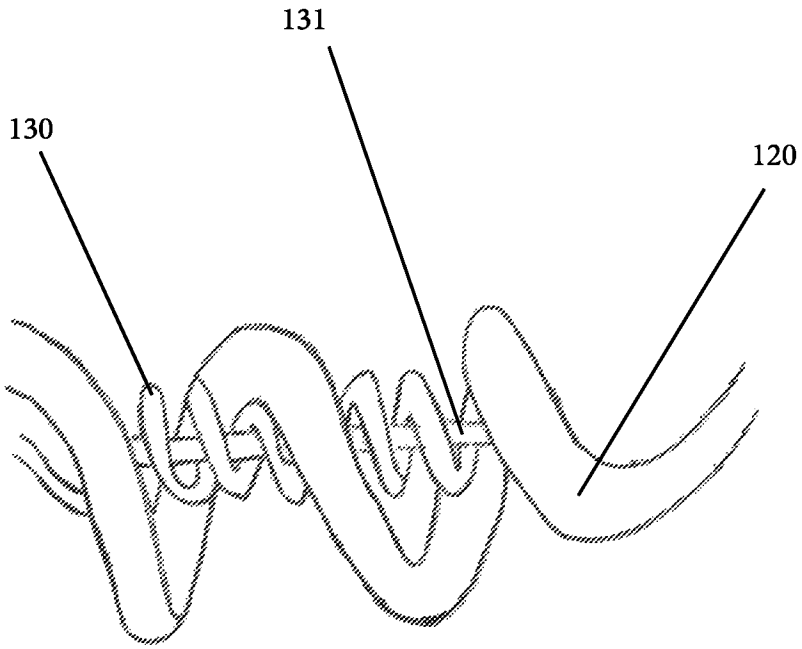
FIG. 8 is a detailed view of the large and small spirals of the exercise device.

FIG. 8 is a detailed view of the large spiral 120, the small spiral 130, and the tubing 131.

Figure 9:
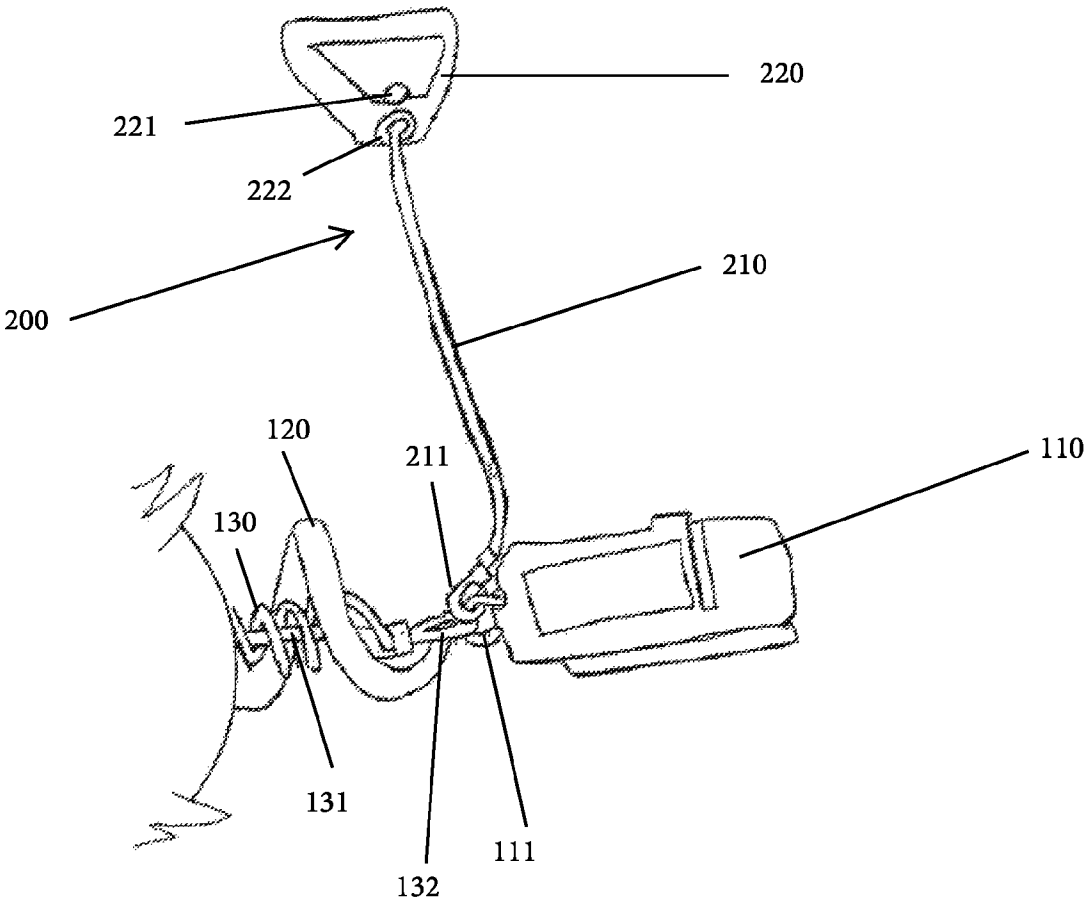
FIG. 9 is a detailed view of the right side of the device.

FIG. 9 is a detailed view of the right side of the device 1000. FIG. 8 shows how all of the parts connect to the leg cuff 110. The arm bands 200 are connected to the leg cuff 110 by the same ring 111 that connects the small spiral 130 to the leg cuff 110. The arm band 200 is connected to the ring 111 via a clip 211. In this embodiment, the clip 211 is constructed from a durable material such as metal or nylon. The end of the tubing 210 forms a loop and held in place with a stop button, tied knot, self-binding knot, or another mechanism. As shown, the clip 211 is inserted around the ring 111 during the manufacturing process. In the embodiment shown, the arm band 210 cannot be removed from the leg cuff 110. In the preferred embodiment, the arm band 210 is attached to the leg cuff 110 using a hook, clasp, carabineer, or another mechanism that allows for a removable arm band 200. This way, the arm band 200 can be detached in order for the user to focus solely on the lower body. The arm bands 200 can also be replaced with different arm bands with more resistance when an exercise calls for greater resistance or less resistance when an exercise calls for less resistance.

Figure 10:
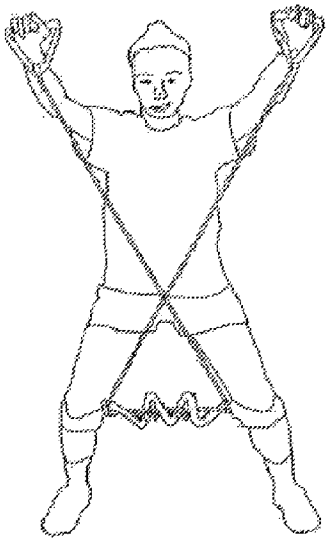
FIG. 10 is an environmental view of the exercise device.
Figure 11:
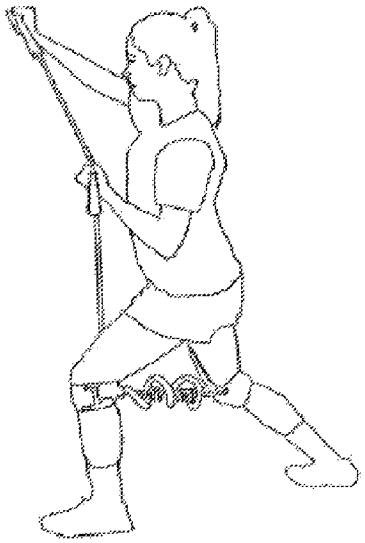
FIG. 11 is an environmental view of the exercise device.

FIGS. 9 and 10 are environmental views that depict different exercises a user might perform with the device 1000.

While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All of the claims as originally filed are hereby incorporated into this specification by reference.

The invention claimed is:

1. An exercise device comprising:

two leg cuffs operably configured to be removably affixed to the legs of a user, two arm bands removably attached to the leg cuffs;

a large spiral constructed from a flexible material fixed there between said two leg cuffs;

a smaller spiral constructed from a flexible material located within the inner diameter of the loops of the large spiral and fixed therebetween said two leg cuffs; and, wherein the large spiral and the smaller spiral are wound in opposite directions whereby when the user performs a leg-exercise using the exercise device the larger and smaller spirals rotate in opposite directions and produce energy directed toward the center.

2. The exercise device according to claim 1 further comprising two arm bands.

3. The exercise device according to claim 1 wherein the large spiral contains an outer and an inner layer.

4. The exercise device according to claim 2 wherein the arm bands are detachable.

5. The exercise device according to claim 3 wherein the inner layer of the large spiral is braided.

6. The exercise device according to claim 1 further comprising a tubing between a loop of the smaller spiral.

7. The exercise device according to claim 1 wherein the leg cuffs are made of nylon.

8. The exercise device according to claim 1 wherein the large spiral is attached to the leg cuffs via a rope stop.

9. The exercise device according to claim 1 wherein the smaller spiral has a first end with a loop around a ring and a second end with a loop around a ring, wherein each ring is attached to a respective leg cuff.

10. The exercise device according to claim 9 wherein the smaller spiral can be removed from the leg cuffs.

11. The exercise device according to claim 9 wherein the smaller spiral is permanently attached to the ring.

12. The exercise device according to claim 9 wherein the ring is a stainless steel D-ring.

13. The exercise device according to claim 1 wherein the smaller spiral is wound in a counter-clockwise direction.

14. A method of exercising comprising:

obtaining a device with two leg cuffs, a large spiral, a smaller spiral, wherein the smaller spiral is located within the inner diameter of the loops of the large spiral, wherein the large and smaller spirals are wound in opposite directions and fixed therebetween the two leg cuffs, and two arm bands with handles;

detaching the smaller spiral, whereby an amount of resistance is lessened;

affixing the leg cuffs to the legs of a user;

placing the handles of the arm bands in hands of the user; and, performing repetitions of training exercises.

15. The exercise device according to claim 1 wherein the large spiral is wound in a clockwise direction.

* * * * *